US008480194B2

(12) United States Patent
Leconte et al.

(10) Patent No.: US 8,480,194 B2
(45) Date of Patent: Jul. 9, 2013

(54) SHELF, IN PARTICULAR FOR REFRIGERATED INSTALLATIONS

(75) Inventors: Jean-Gerard Leconte, Courbevoie (FR); Francois Vardon, Qro (MX)

(73) Assignee: Saint-Gobain Glass France, Courbevoie (FR)

( * ) Notice: Subject to any disclaimer, the term of this patent is extended or adjusted under 35 U.S.C. 154(b) by 115 days.

(21) Appl. No.: 12/514,467

(22) PCT Filed: Apr. 8, 2009

(86) PCT No.: PCT/FR2009/050621

§ 371 (c)(1), (2), (4) Date: May 12, 2009

(87) PCT Pub. No.: WO2009/136078

PCT Pub. Date: Nov. 12, 2009

(65) Prior Publication Data

US 2011/0062845 A1 Mar. 17, 2011

(30) Foreign Application Priority Data

Apr. 9, 2008 (FR) ..... 08 52392
Sep. 23, 2008 (FR) ..... 08 56399
Dec. 17, 2008 (FR) ..... 08 58741

(51) Int. Cl.
*A47B 96/00* (2006.01)

(52) U.S. Cl.
USPC ..... 312/408; 108/108

(58) Field of Classification Search
USPC ..... 312/401, 408, 410, 351; 108/106, 108/107, 108; 211/153
See application file for complete search history.

(56) References Cited

U.S. PATENT DOCUMENTS 3,439,812 A * 4/1969 Nagelkirk ..... 211/90.04
4,508,301 A * 4/1985 Nicholson et al. ..... 248/250
4,537,002 A * 8/1985 Ellingson ..... 52/204.591

(Continued)

FOREIGN PATENT DOCUMENTS

CH 662 929 11/1987
WO 02 076268 10/2002
WO WO 2006059038 A1 * 6/2006

OTHER PUBLICATIONS

Machine Translation of disclosure of CH 662929, Support frame, in particular for accomodating a shelf. www.espacenet.com.*

(Continued)

*Primary Examiner* — James O Hansen
*Assistant Examiner* — Kimberley S Wright
(74) *Attorney, Agent, or Firm* — Oblon, Spivak, McClelland, Maier & Neustadt, L.L.P.

(57) ABSTRACT

A shelf for an item of furniture, especially for a refrigerator or the like, includes a panel for supporting articles and a frame capable of enclosing the panel by its actual surrounding part, the frame configured to allow the shelf to be fitted into the body of the furniture. The shelf further includes at least one retaining member for retaining the panel at its lower part, which retaining member can be inserted laterally into a hole made in a rib of the frame, which rib runs along the panel, being offset internally relative to the external peripheral edge of the frame, and extends beyond the panel, and then can be fastened onto or behind the border wall of the hole, the retaining member bearing, in the fastened position, against the panel.

21 Claims, 6 Drawing Sheets

U.S. PATENT DOCUMENTS

| | | | | |
|---|---|---|---|---|
| 4,745,775 | A * | 5/1988 | Bussan et al. | 62/382 |
| 4,934,541 | A * | 6/1990 | Bussan et al. | 211/153 |
| 5,064,158 | A * | 11/1991 | Brazier et al. | 248/250 |
| 5,228,764 | A * | 7/1993 | Cherry et al. | 312/408 |
| 5,297,486 | A * | 3/1994 | Herrmann et al. | 108/108 |
| 5,406,894 | A * | 4/1995 | Herrmann et al. | 108/108 |
| 5,441,338 | A * | 8/1995 | Kane et al. | 312/408 |
| 5,524,981 | A * | 6/1996 | Herrmann et al. | 312/408 |
| 5,735,589 | A * | 4/1998 | Herrmann et al. | 312/408 |
| 6,210,618 | B1 * | 4/2001 | Bird et al. | 264/237 |
| 6,422,673 | B1 * | 7/2002 | Bienick | 312/408 |
| 6,488,347 | B1 * | 12/2002 | Bienick | 312/408 |
| 6,679,573 | B2 * | 1/2004 | Bienick | 312/408 |
| 6,811,045 | B1 * | 11/2004 | Masker et al. | 211/153 |
| 6,851,776 | B2 * | 2/2005 | Bienick | 312/408 |
| 7,188,917 | B2 * | 3/2007 | Bienick | 312/408 |
| 7,237,855 | B2 | 7/2007 | Vardon | |
| 7,300,122 | B2 | 11/2007 | Vardon | |
| 7,306,304 | B2 * | 12/2007 | Jang | 312/408 |
| 2002/0149304 | A1 * | 10/2002 | Bienick | 312/408 |
| 2002/0190620 | A1 | 12/2002 | Vardon | |
| 2003/0151340 | A1 * | 8/2003 | Mathur et al. | 312/408 |
| 2005/0088070 | A1 * | 4/2005 | Vardon | 312/408 |
| 2005/0093409 | A1 | 5/2005 | Vardon | |
| 2005/0280341 | A1 * | 12/2005 | Vardon | 312/408 |
| 2006/0145577 | A1 * | 7/2006 | Daley et al. | 312/408 |
| 2006/0162373 | A1 * | 7/2006 | McMillin et al. | 62/440 |
| 2006/0254481 | A1 | 11/2006 | Lee et al. | |
| 2008/0197760 | A1 | 8/2008 | Leconte et al. | |
| 2009/0134758 | A1 | 5/2009 | Vardon | |

OTHER PUBLICATIONS

Machine Translation of Abstract of CH 662929, Support frame, in particular for accomodating a shelf. www.espacenet.com.*

Machine Translation KR 100559722, "Shelf of Refrigerator", accessed on http://kposd.kipo.go.kr:8088/up/kpion/.*

* cited by examiner

Fig.8
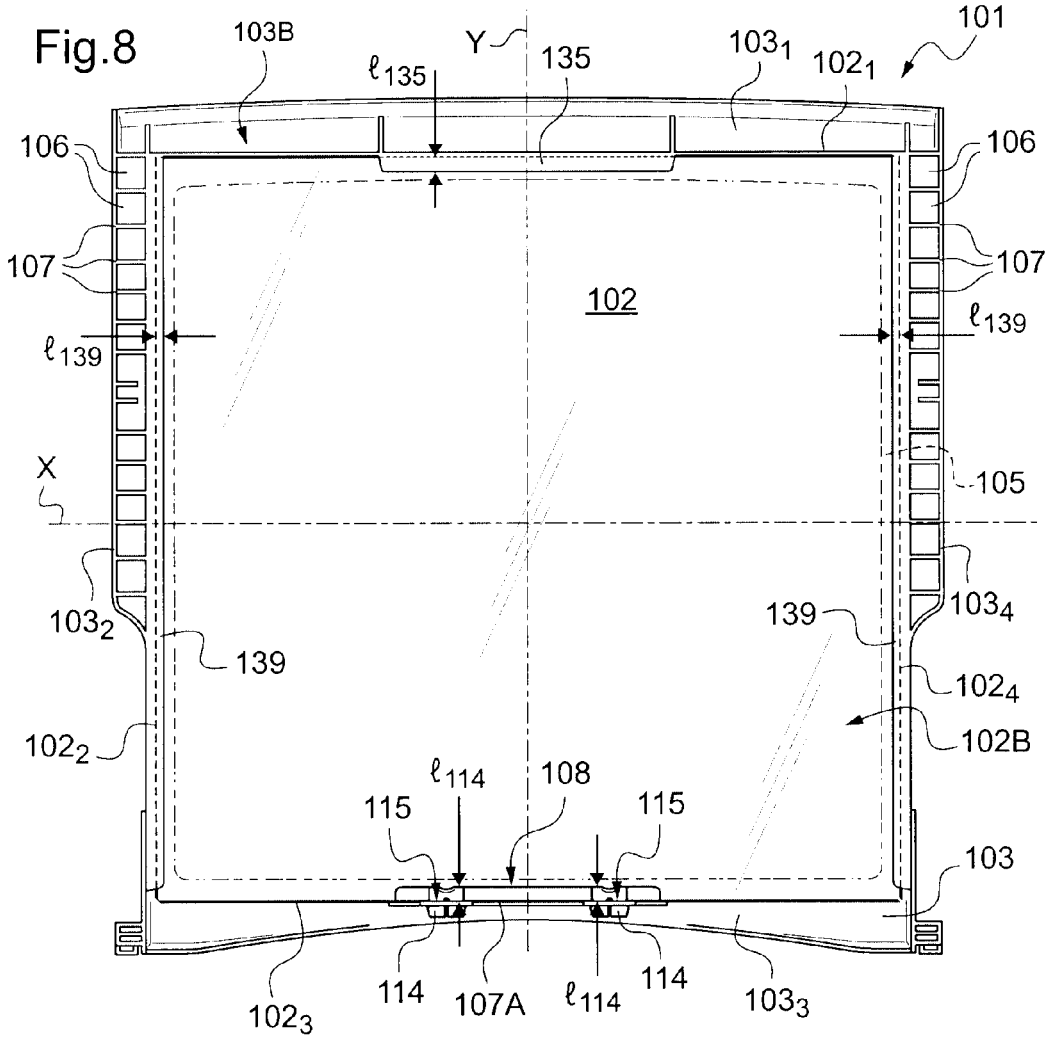
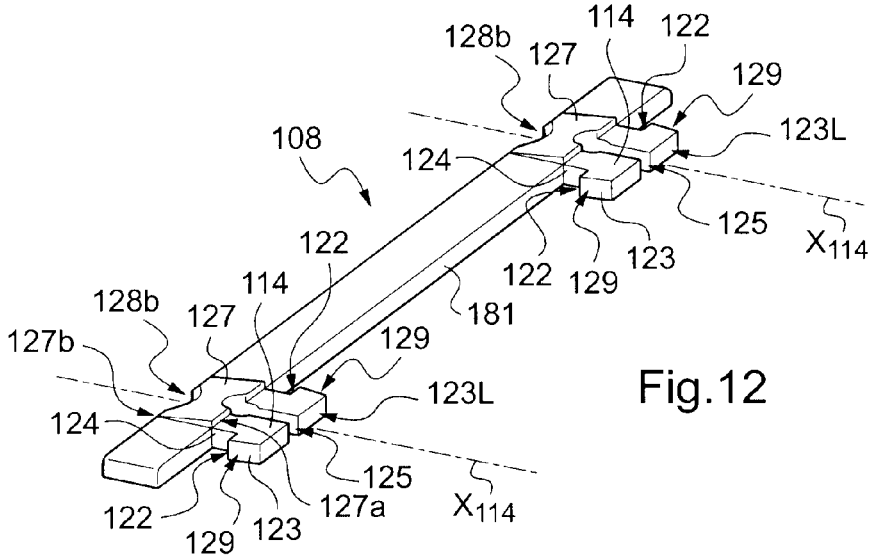
Fig.12

SHELF, IN PARTICULAR FOR REFRIGERATED INSTALLATIONS

CROSS-REFERENCE TO RELATED APPLICATIONS

The present application is the U.S. counterpart of PCT/FR2009/050621 and claims priority to French application Ser. No. 08/52392 filed on Apr. 9, 2008, French application Ser. No. 08/56399 filed on Sep. 23, 2008, and French application Ser. No. 08/58741 filed on Dec. 17, 2008, the entire contents of each of which are hereby incorporated herein by reference.

BACKGROUND OF THE INVENTION

I. Field of the Invention

The present invention relates to a shelf for supporting articles, which is intended to be fastened or fitted, advantageously so as to be able to be removed, in the body of an item of furniture. In particular, the invention relates to a shelf that can be used in refrigerated compartments, such as refrigerated cabinets, refrigerating apparatus and refrigerators, for supporting articles, particularly food.

II. Description of Related Art

These shelves consist of solid plates made of mineral glass or organic glass, such as polycarbonate or polymethyl methacrylate, whether monolithic or laminated and whether transparent, translucent or opaque, these being provided with a plastic surround, whether complete or partial, obviating the risk of injury on the sharp edges of the plates and/or strengthening said plates.

Moreover, the edges of the plastic surround may be straight and uniform, or of more complex shape, possibly having in particular peripheral parts or extensions for functional or esthetic purposes. Thus, the front edge may form a handle for gripping the shelf and the lateral and rear edges are generally designed to cooperate with the body of the furniture, said body generally bearing racks for supporting the shelves, or supporting grooves or ribs in the side walls.

There are various assembly methods for joining the plastic surround to the glass panel: by encapsulation molding; by attaching a surround to the panel, for example by bonding, clip-fastening or interlocking the sides of the surround; or by shrinking the surround just after molding, the panel being in this case joined to the surround just after leaving the mold, before the plastic has completely shrunk.

These shelves are satisfactory through their practical and attractive shapes, and also by the fact that the assembly methods, in particular shrinkage methods, make it possible to achieve good consolidation and, where appropriate, good sealing between the glass panel and the plastic surround.

The present invention pertains to shelves for which the plastic surround encloses the edges or edge sides of the panel, especially by the plastic shrinking, such shelves having been disclosed by the filing company in the PCT international applications WO 02/076268 A1 and WO 06/059038 A1.

The surrounds of the shelves thus disclosed comprise at least one inward rim applied to the article support panel on at least one of the two faces of the panel. In practice, an inward rim is applied over the entire perimeter of the upper face of the panel, when considered in the use position. In this way, if any liquid flows out from food items placed on the shelf, it is retained by the vertical end border of this rim. In addition, beneath the lower face of the panel when considered in the use position, several rims of the surround are applied, these taking the form of rigid retaining lugs distributed over the entire perimeter of the panel.

In fact, these retaining lugs could be dispensed with, in particular if the frame is shrunk onto the panel, but it is preferable to provide them for safety reasons.

However, during manufacture, these retaining lugs, molded with the panel surround, prove to be problematic.

In most cases, the panel can be put into place without touching the aforementioned lugs, in particular if this operation takes place very rapidly after the frame leaves the mold and therefore within a period when the frame has practically not yet shrunk upon cooling.

However, in other cases, shelf manufacture requires a handling operation, this being all the more tricky the hotter the frame and since the lugs are rigid. As a result therefore, it is impossible to automate the insertion of the glass panel into the plastic frame.

BRIEF SUMMARY OF THE INVENTION

The object of the present invention is to remedy these drawbacks, by providing a shelf for an item of furniture, especially for a refrigerator or the like, which has a rigidity suitable for its function and of which the method of manufacturing is simple and can, for the most part, be automated.

For this purpose, one subject of the invention is a shelf for an item of furniture, especially for a refrigerator or the like, comprising a panel for supporting articles and a frame capable of enclosing the panel by its actual surrounding part, the frame being designed to allow the shelf to be fitted into the body of the furniture, the shelf further including at least one retaining member for retaining the panel at its lower part, wherein the retaining member can be inserted laterally into a hole made in a rib of the frame, which rib runs along the panel, being offset internally relative to the external peripheral edge of the frame, and extends beyond the panel, and then can be fastened onto or behind the border wall of the hole, the retaining member bearing, in the fastened position, against the panel.

Within the context of the invention, the term "frame" denotes a frame covering all the edges of the panel or covering only part of the edges of the panel.

Thanks to the invention, the lower face of the panel is retained by at least one retaining member which is a piece attached by the operator once the panel has been inserted into the frame. This insertion of the panel into the frame, which takes place without any difficulty insofar as it is possible to limit, or even eliminate, the presence of rims on the lower face of the frame liable to interfere with the sides of the panel, can therefore be automated.

According to other advantageous features of a shelf in accordance with the invention, taken individually or in any technically possible combination:

- the retaining member of the panel on its lower face relative to the frame can be inserted into a hole made in a rib of the frame which, when the frame is enclosing the panel, runs along the panel, being internally offset relative to the external peripheral edge of the frame, and projects from the lower face of the panel;
- the rib of the frame forms an internal border on the sides of the frame;
- the internal face of the rib is coincident with the internal face of the wall of the frame that encloses the panel over its entire thickness in the fitted position;
- the retaining member comprises a first part and a second part which, in the configuration with the retaining member in the hole, bear respectively against the lower face of the panel on one side of the hole and against the rib on the inside or on the other side of the hole;

the retaining member is suitable for being inserted into the hole via the internal side of the rib relative to the panel;

the retaining member is a plate which is extended at one of its edges by a bar for insertion into the hole, the bar bearing, on the outside, a succession of catching teeth, as sawteeth, capable of being locked into the wall defining the hole, the plate and the bar bearing, in the configuration with the retaining member in the hole, respectively against the lower face of the panel and the rib on one side of the hole and against the rib on the inside of the hole;

the retaining member is a plate comprising a first part and a second part, the second part being a part with a tapered end that can be inserted into the hole, the first and second parts bearing, in the configuration with the retaining member in the hole, respectively against the lower face of the panel and the rib on one side of the hole and against the rib on the other side of the hole;

the retaining member comprises a first part and a second part joined together in at least one shoulder of the retaining member, the second part being elastically deformable and capable of being inserted into the hole, the first and second parts bearing, in the configuration with the retaining member in the hole, respectively against the lower face of the panel and the rib on one side of the hole and against the rib on the other side of the hole;

the second part of the retaining member includes at least one slot which is directed along the direction of insertion of the second part into the hole and which divides the second part into subparts capable of coming closer together elastically when stressed;

the second part of the retaining member has at least one lateral edge inclined toward a central axis of the second part from the shoulder to a free edge of the second part;

the retaining member has a flange which, in the configuration with the retaining member in the hole, butts against the rib;

the flange has, in at least one of its external walls, a recessed zone for applying a thrust force on the retaining member;

the first part of the retaining member is rigid and has a width, along a direction of the retaining member perpendicular to the rib of the frame in the configuration with the retaining member in the hole, greater than about 0.5 centimeters, preferably at least around 0.8 centimeters;

the constituent material of the retaining member has a thermal expansion coefficient lower than the thermal expansion coefficient of the constituent material of the frame;

the shrinkage of the frame is at least 0.25%, preferably between 0.5% and 2% and more preferably around 1.5%, relative to the dimensions of the frame in its main plane;

the shelf includes a piece comprising several retaining members joined together and capable of retaining the panel simultaneously at several places on the periphery of the panel;

the rib is formed, continuously or discontinuously, over the entire perimeter of the frame;

the frame includes a plurality of holes distributed over the perimeter of the frame;

the frame has first and second opposed sides intended to face first and second opposed sides of the panel respectively, the first side of the frame having a rigid rim for bearing against the lower face of the panel, while the second side of the frame has at least one rib, running along the panel and projecting from the lower face of the panel when the frame is enclosing the panel, which defines at least one hole for accommodating a retaining member;

the shelf includes a piece comprising at least two retaining members joined together, the various retaining members of the piece being able to be accommodated simultaneously in various holes made in at least one rib on the second side of the frame;

the rigid rim of the first side of the frame intended to bear against the lower face of the panel has a width, along a direction perpendicular to the first side of the frame, greater than about 0.5 centimeters, preferably between about 0.8 centimeters and about 1 centimeter.

Another subject matter of the present invention is a method of manufacturing a shelf as defined above, which method comprises:

placing the frame still hot on leaving the mold on a support;

inserting the panel into the still-hot frame, from the side of the face of the frame which is intended to be its lower face when the shelf is in its use position;

inserting the or each retaining member into a hole made in a rib of the frame so that the first part and the second part of the retaining member bear respectively against the lower face of the panel on one side of the hole and against the rib on the inside or on the other side of the hole.

Advantageously, the or each retaining member is inserted into a hole of a rib of the frame before the frame has completely shrunk and via the internal side of the rib relative to the panel.

According to one embodiment, the panel is inserted into the still-hot frame by introducing the first side of the panel beneath the rigid rim of the first side of the frame and then depositing the panel between the other sides of the frame.

The final subject of the invention is an item of furniture, such as a refrigerated cabinet, a refrigerating apparatus or a refrigerator, comprising at least one shelf as defined above.

BRIEF DESCRIPTION OF THE DRAWINGS

To better illustrate the shelf according to the present invention, particular embodiments thereof will be described below with reference to the appended drawings in which:

FIG. 8 is a view from below, similar to FIG. 2, for a shelf according to a second embodiment of the invention;

FIG. 12 is a perspective view on a larger scale of a single piece incorporating retaining members of the shelf of FIG. 8.

DETAILED DESCRIPTION OF THE INVENTION

Figure 1:
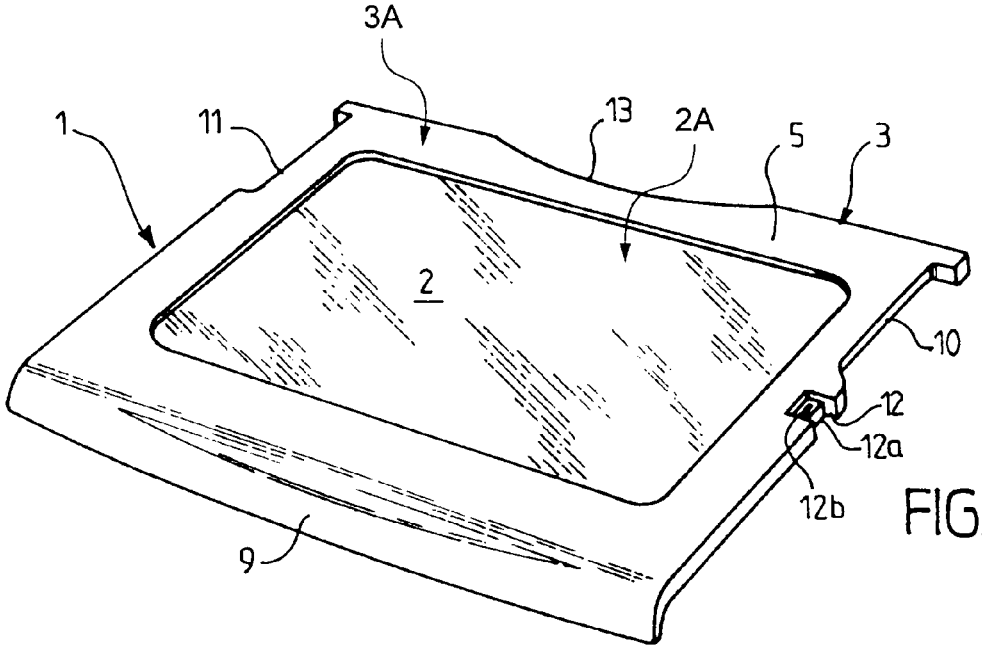
FIG. 1 is a perspective view of a shelf according to a first embodiment of the invention, showing that face of the shelf which is its upper face when the shelf is in the use position.
Figure 2:
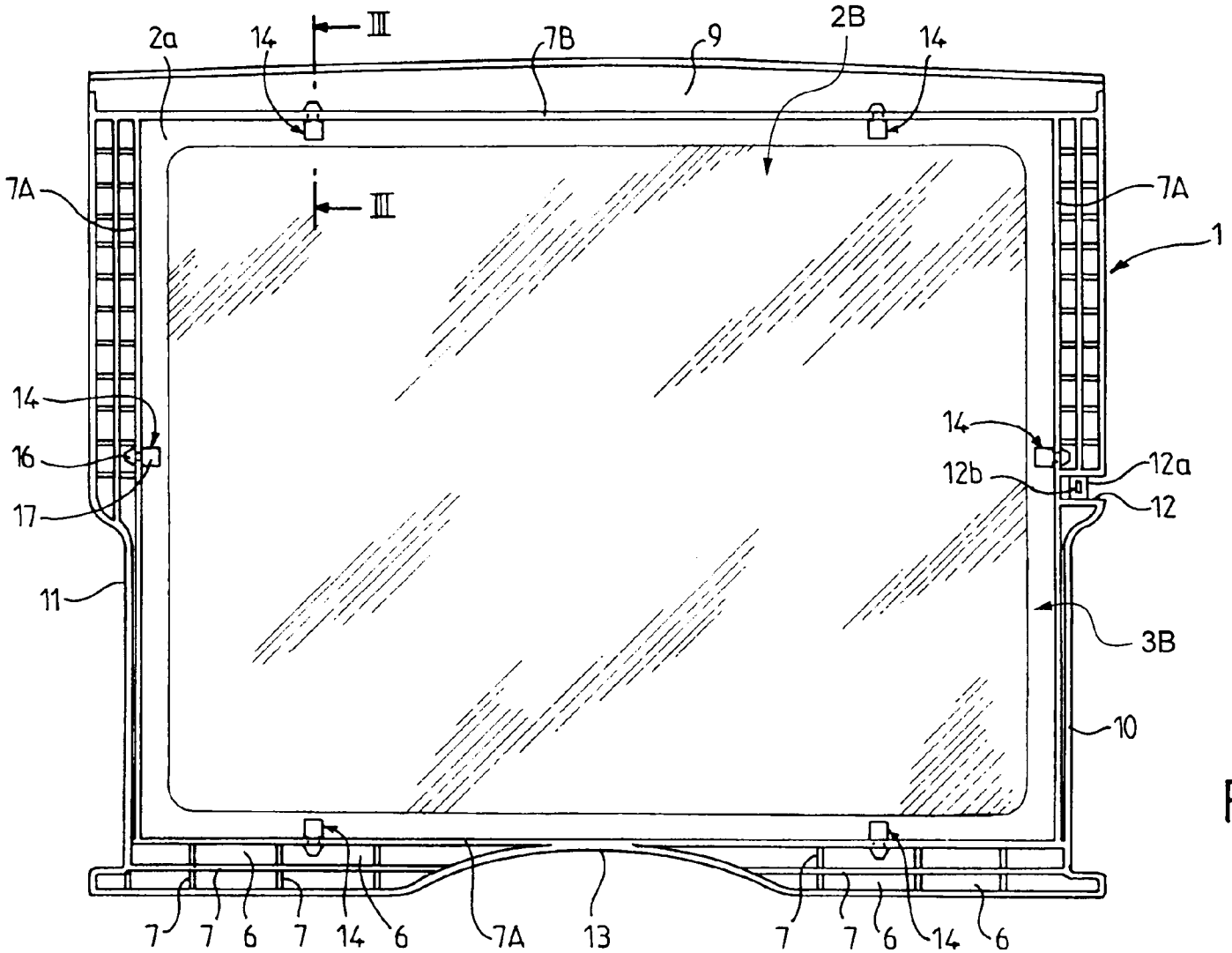
FIG. 2 is a view from below on a larger scale of the shelf of FIG. 1.

FIGS. 1 and 2 show a shelf 1 according to the invention, intended for being fitted, for example, into a refrigerator. In the following description, the terms "front", "rear", "right", "left", "lower", "upper", "vertical" and "horizontal" and the equivalent expressions will be used to refer to the position in which the shelf is used when in place in a refrigerator, the user facing the shelf in question.

The shelf 1 comprises a rectangular panel 2 made of mineral or organic glass, provided with a frame 3 made of a relatively rigid plastic, such as polypropylene. The frame 3 is designed to allow the shelf 1 to be fitted into the body of the refrigerator, i.e. it includes fitting means suitable for cooperating with complementary means provided in the body of the refrigerator. The frame 3, of flattened parallelepipedal general shape, comprises an actual surrounding part, having a vertical internal wall 4 which defines a rectangular outline of greater height than the thickness of the glass panel 2 and which encloses the latter over its entire thickness when in the fitted position.

The distance between the wall 4 of the frame 3 and the edges of the glass panel 2 is small, in particular zero, at least in certain places, as results from the chosen method of manufacture, which will be described later and involves the frame 3 being shrunk around the panel 2 just after the frame 3 has been molded. This method of assembling the frame 3 with the panel 2 ensures that the assembly is held together and sealed.

On its upper face 3A and over its entire perimeter, the frame 3 forms an inward rim 5 of small thickness, which is intended to be applied against the upper face 2A of the glass panel 2, its free border being for example of rectangular shape with rounded corners, as shown in FIG. 1. The upper face of the rim 5 lies in the extension of the upper face of the actual surround of the frame 3, so as to constitute a perfectly smooth top of the frame 3. The lower face 2B of the glass panel 2 may be provided with an enameled border 2*a*, for example in correspondence with the upper rim 5, as visible in FIG. 2.

The lower face 3B of the frame 3 is not smooth like the upper face 3A, but has, in its rear, right and left sides or border regions, cells 6 separated by ribs 7. This saves material in these regions, while still maintaining sufficient rigidity for the frame 3. These cells 6 and ribs 7 may be obtained by the technique referred to as "air molding".

Such ribs 7 form an internal border of the rear, right and left sides or regions of the frame 3, their internal vertical faces being coincident with the internal face of the vertical wall 4 of the frame. These perimeter ribs are denoted by 7A in FIG. 2 and form a closed perimeter with a rib 7B of the same type formed along the vertical wall 4 of the front region of the frame 3. Thus, a rib 7A, 7B, offset internally relative to the external peripheral edge of the frame 3, is formed continuously over the entire perimeter of the frame, the frame 3 having a plurality of holes 15 provided in the rib 7A, 7B and distributed over the perimeter of the frame.

To complete the description of the shelf 1 according to the invention, it may be pointed out that:

- the frame 3 is, for example, turned down in its front part at 9, so as to form a handle for handling the shelf 1;
- the right and left edges of the shelf 1 have, for example, in the rear region, elongate indents with curved edges, the indents 10 and 11 respectively, the right edge furthermore having, in its central part, a U-shaped indent 12, the bottom of which has a rib 12*a* provided with a central hole 12*b* of axis parallel to the internal vertical wall 4 of the frame 3; and
- the rear edge of the shelf 1 has a circularly arcuate central indent 13.

The role of these particularly shaped cut-outs on the edges of the shelf 1 depends on the body and on the structure (such as a rack) for supporting the shelf 1 in the refrigerator, and also on the method of inserting and removing it. Thus, it is common practice to ensure that, for safety reasons, the shelf cannot be entirely removed directly, but firstly withdrawn over only a part thereof. Since these cut-outs and details do not concern the present invention and are merely particular examples, they will not be described here further.

In accordance with the present invention, the shelf 1 comprises retaining members 14, 14D, for retaining the panel 2 in the frame 3 on its lower face 2B.

Figure 3:
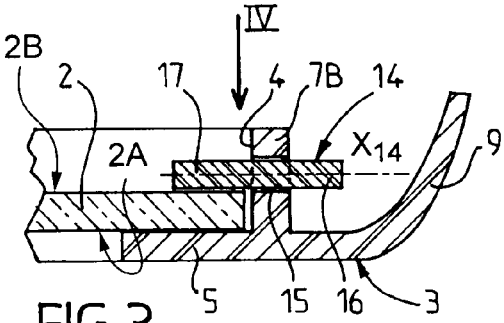
FIG. 3 is a cross section on a larger scale on the line III-III of FIG. 2.
Figure 4:
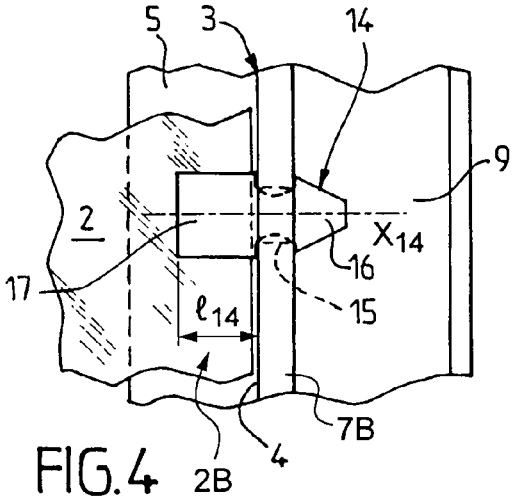
FIG. 4 is a partial top view along the arrow IV of FIG. 3.

A first embodiment of a retaining member 14 of the shelf 1 is shown in FIGS. 2 to 4. The retaining member 14, the longitudinal central axis of which is denoted by $X_{14}$, consists of a plate of rectangular cross section, each of the two long sides of which has an indent substantially of circularly arcuate shape, the two corners of the plate being cut off obliquely on the same side of the circularly arcuate indents. What is therefore formed is a tapered end part or region 16 of the plate for facilitating its insertion into a hole 15, for example a cylindrical hole, which is formed in the rib 7A, 7B and via which the plate behind the border of the hole 15 is attached after its insertion into said hole, the opposite region or part 17 of the plate, which is wider, then retainingly bearing on the panel 2.

In other words, the retaining member 14 of this first embodiment is a plate having two end parts 16 and 17, the end part 16 being a tapered end part that can be inserted into the hole 15 in such a way that, in the configuration with the retaining member 14 in the hole 15, the parts 16 and 17 are immobilized on each side of the hole 15, bearing respectively against the lower face 2B of the panel 2 and the rib 7A, 7B in the case of the part 17 and against the rib 7A, 7B in the case of the part 16.

Figure 6:
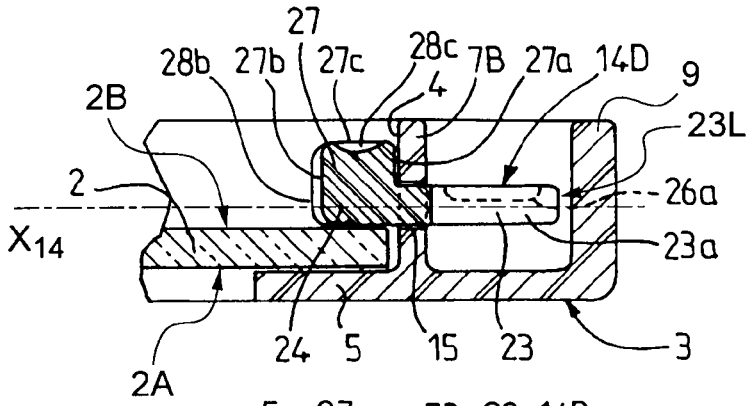
FIG. 6 is a cross section on the line VI-VI of FIG. 5.
Figure 5:
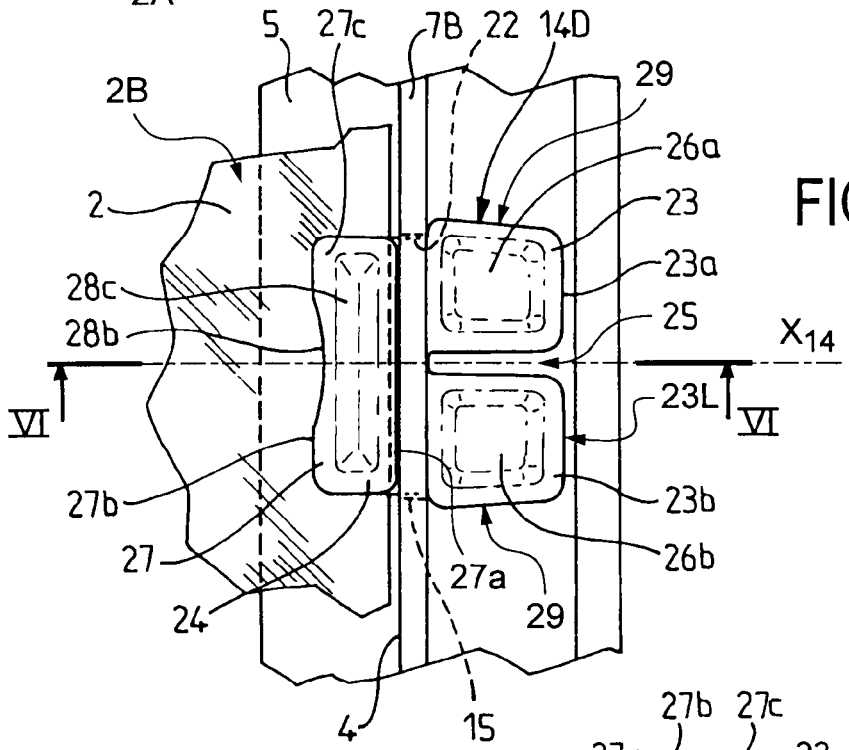
FIG. 5 is a view similar to FIG. 4, showing an alternative embodiment of the retaining member of the shelf visible in FIG. 4.
Figure 7:
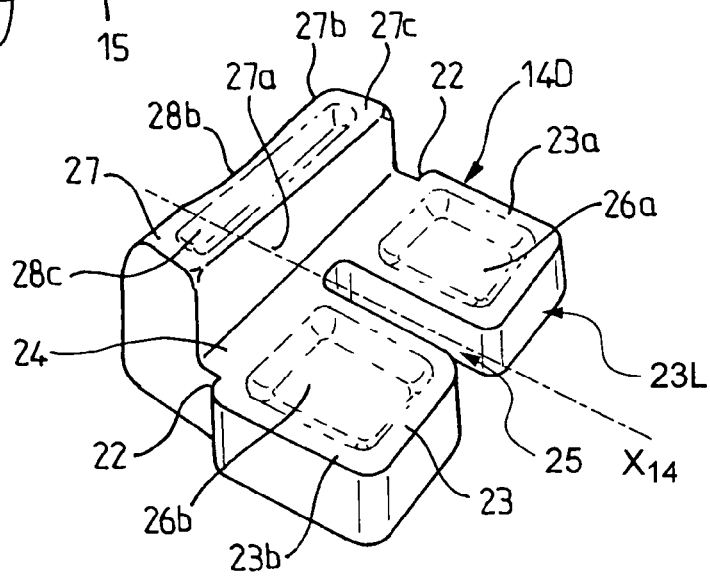
FIG. 7 is a perspective view of the retaining member of the shelf visible in FIG. 5.
Figure 9:
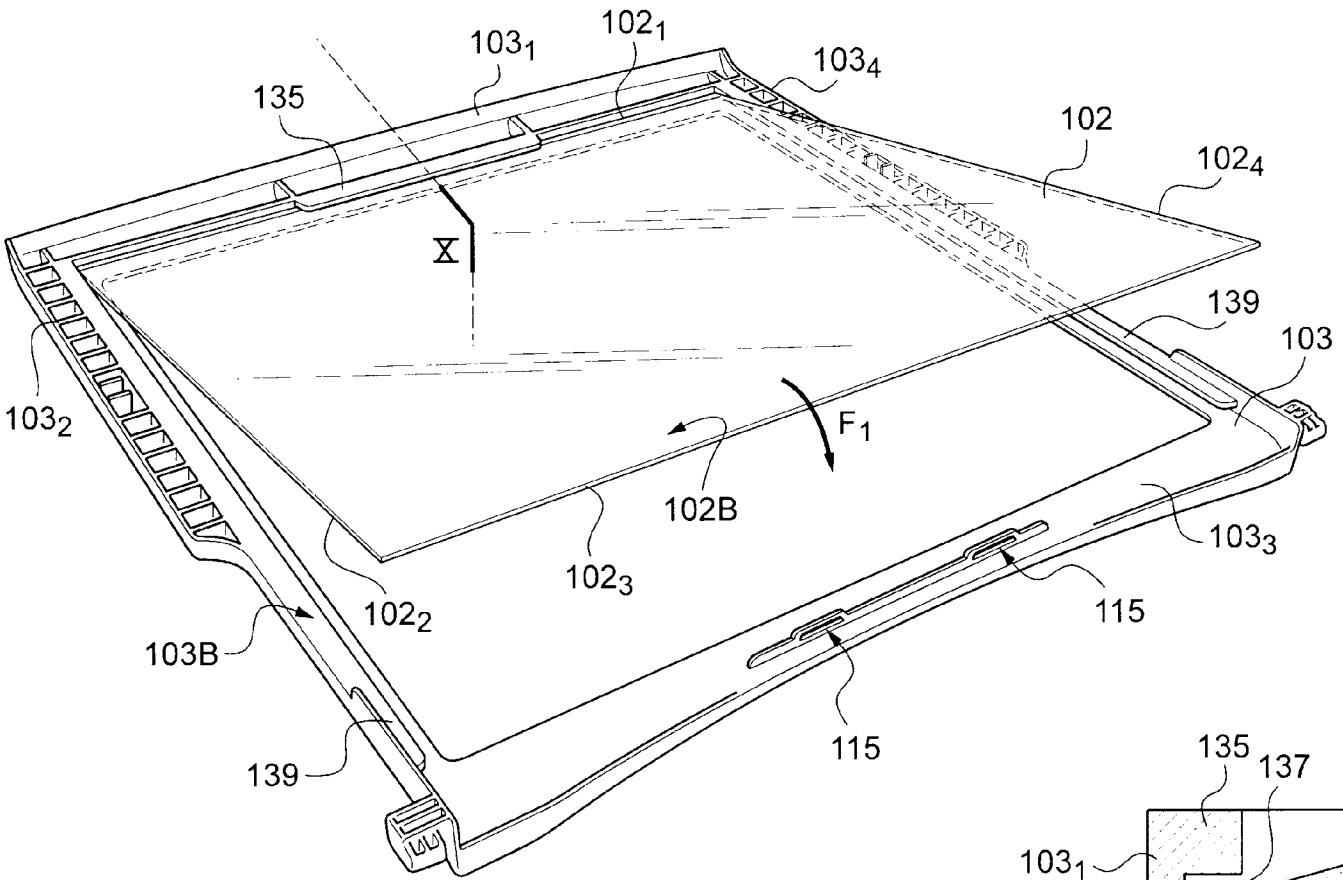
FIG. 9 is a perspective view of the shelf of FIG. 8 during a first step of the method for manufacturing it.

FIGS. 5 to 7 show a second embodiment of a retaining member 14D of the shelf 1. The retaining member 14D consists of a generally flat piece having an overall shape of rectangular cross section. Each of the lateral edges of the member 14D has, roughly mid-way, an inward shoulder or step 22. The retaining member 14D may thus be considered, if the direction of insertion of the member 14D into the hole 15 is taken into account, this being the direction of the central longitudinal axis $X_{14}$ of the member 14D, to be divided into a first part 24 and a second part 23, or rear part 24 and front part 23 in the case of the retaining member which is cut along the line III-III of FIG. 2, with reference to the position in which the shelf 1 is used.

The second part 23 is intended to be inserted into the hole 15 and has a central slot 25, directed parallel to the central axis $X_{14}$ and perpendicular to a free end edge 23L of the second part 23, which slot extends practically as far as level with the shoulders 22 and divides the second part 23 into two subparts 23*a*, 23*b* capable of coming closer together elastically. Shallow cavities 26*a*, 26*b* are formed in the upper part of each of the resulting subparts 23*a*, 23*b*, giving the part 23 a little flexibility.

Moreover, each of the two lateral edges 29 of the second part 23 is inclined toward the central axis $X_{14}$, from the corresponding shoulder 22 to the free edge 23L, so as to facilitate the insertion of the member 14D into the hole 15. To insert it into the hole 15, the retaining member 14D is placed on the panel 2, then slid toward and forcibly pushed into the hole 15 via its second part 23, until catching thanks to the shoulders 22 delimiting the parts 23 and 24. In the configuration with the retaining member 14D in the hole 15, the first part 24 is immobilized and bears against the lower face 2B of the panel 2 and the rib 7A, 7B on one side of the hole 15, while the second part 23 is immobilized and bears against the rib 7A, 7B on the other side of the hole 15.

The first part 24 comprises a flange 27 formed on its upper face and intended, in the fitted position, to bear via a face 27*a* against the rib 7A, 7B, as clearly visible in FIG. 6. Made in the face 27*b* opposite the face 27*a* and in the upper face 27*c* of the flange 27 are recesses 28*b* and 28*c* respectively, for positioning a finger and making it easier to push the member 14D into the hole 15 during the fitting operation. In the mounted position, each retaining member 14D is prevented from moving, along the $X_{14}$ axis, in one direction by the shoulders 22 and in the other direction by the flange 27 butted against the rib 7A, 7B.

Irrespective of the embodiment in question of a retaining member of the shelf 1, the part 17 or 24 of the retaining member 14 or 14D, which is intended to bear against the lower face 2B of the panel 2, in order to retain the latter, is rigid and advantageously has a width $l_{14}$ taken along the direction of the central axis $X_{14}$ of the retaining member, i.e. along a direction perpendicular to the rib 7A, 7B of the frame 3 in the configuration with the retaining member in the hole 15 of this rib, greater than about 0.5 centimeters and preferably at least around 0.8 centimeters.

In addition, in the two embodiments described above of a retaining member of the shelf 1, the retaining member 14 or 14D is advantageously made of a polymer having good mechanical strength properties, such as ABS or HIPS (high-impact polystyrene) and formed by injection molding. Advantageously, the constituent material of the retaining member 14, 14D has a thermal expansion coefficient lower than the thermal expansion coefficient of the constituent material of the frame 3, this being the case for a retaining member 14, 14D made of ABS or HIPS and a frame 3 made of polypropylene. The choice of a material having a low thermal expansion coefficient ensures good rigidity of the retaining member 14, 14D.

The shelf 1 according to this first embodiment of the invention is obtained by forming the plastic frame 3 by hot molding, the glass panel 2 being assembled with the frame 3 as it leaves the mould before complete shrinkage of the plastic. Details relating to this shrinkage method of assembly (temperatures, duration of the steps, etc.) may be found in PCT international application WO 02/076268 A1 in the name of the filing company. The shrinkage of the frame 3 is at least 0.25%, advantageously between 0.5% and 2%, preferably around 1.5%, relative to the width and/or the length of the frame in its main plane, which is a plane parallel to the plane of the panel 2 in the assembled configuration. Such a percentage shrinkage of the frame 3 is obtained thanks to the suitable constituent material of the frame, which is polypropylene having a high melt flow index, at least equal to 20 grams/10 minutes.

A method of manufacturing the shelf 1 comprises steps such as those described below.

Firstly, the frame 3 still hot on leaving the mold is placed on a support. For example, the frame 3 is placed on the support via its face 3A, which includes the rim 5 and is intended to be the upper face of the frame 3 in the position in which the shelf 1 is used.

Next, the panel 2 is placed in the frame 3, before the latter has completely shrunk, from the side of the face 3B of the frame intended to be its lower face when in the position in which the shelf is used. The panel 2 is placed in the frame 3 while the frame is in a state sufficiently hot and expanded for there to be no interference between the internal wall 4 of the frame and the sides of the panel 2. Positioning the panel 2 is easy since, in this embodiment, the frame 3 does not have a rim on its lower face 3B.

The frame is then left to partially shrink around the panel 2. In this way, the assembly is consolidated, the frame 3 enclosing the panel 2 thanks to the internal wall 4, which is provided with a height greater than the thickness of the panel 2 and which encloses the panel over its entire thickness.

Once the frame 3 has partially shrunk, but preferably before it has completely shrunk, the panel 2/frame 3 assembly is strengthened and locked, for safety reasons, by fitting, as described above, at least one retaining member 14 or 14D. This fitting operation is generally carried out once the frame 3 is in position enclosing the panel 2. For this purpose, the or each retaining member 14, 14D is inserted into one of the holes 15 of the ribs 7A, 7B of the frame 3, by applying a thrust force on the part 17 or 24 of the member, in such a way that the part 17 or 24 of the retaining member is immobilized and bears against the lower face 2B of the panel 2 on a first side of the hole 15 and the part 16 or 23 is immobilized and bears against the rib 7A, 7B on the other side of the hole 15 in the configuration with the retaining member in the hole 15.

The constituent material of the frame 3 continues to cool down, and therefore shrink, thereby, on the one hand, increasing the clamping force of the retaining member(s) 14, 14D, making it very difficult to remove it/them, and, on the other hand, further consolidating the frame 3/panel 2 assembly and improving the sealing between them. This has great practical importance since the shelf 1 is intended to support food products that may spread out and slip into the plastic/glass join regions, to the detriment of proper use of the refrigerator.

Particularly advantageously, the or each retaining member 14, 14D is inserted into the hole 15 via the internal side of the rib 7A, 7B relative to the panel 2. It follows that the gripping part 17 or 24 of the retaining member is housed behind the rib 7A, 7B. Such an arrangement makes it difficult to extract the retaining member from the hole in the configuration in which the shelf 1 is used and helps to secure the locking of the panel 2 onto the frame 3. Furthermore, as shown in FIG. 2, in the configuration in which the or each retaining member 14, 14D is housed in the corresponding hole 15, the retaining member does not extend beyond the external peripheral edge of the frame 3. This results from the arrangement of the rib 7A, 7B, which is internally offset relative to the external peripheral edge of the frame 3. Thus, no retaining member 14, 14D interferes with the means for fitting the shelf 1 that are provided on the frame 3, thereby preventing any impediment when fitting the shelf into the body of a refrigerator.

In the second embodiment shown in FIGS. 8 to 12, the elements similar to those of the first embodiment bear the same references but increased by 100. Similarly to the first embodiment, the shelf 101 in accordance with this second embodiment comprises a glass panel 102 and a frame 103 having four sides $\mathbf{103}_1$, $\mathbf{103}_2$, $\mathbf{103}_3$, $\mathbf{103}_4$, made of a relatively rigid plastic, for example polypropylene. The frame 103 comprises an actual surrounding part, a vertical internal wall 104 of which, having a height greater than the thickness of the glass panel 102, encloses the latter over its entire thickness in the configuration in which the frame is mounted on the panel.

The frame 103 forms, on its upper face 103A and over its entire perimeter, an inward rim 105, of small thickness, shown by the dotted lines in FIG. 8 and intended to bear on the upper face 102A of the glass panel 102. The lower face 103B of the frame 103 includes, in its right and left sides or border regions, cells 106 separated by ribs 107. As in the first embodiment, such a configuration saves material in these regions, while still maintaining sufficient rigidity of the frame 103.

The frame 103 of the shelf 101 in accordance with this second embodiment differs from the frame 3 described above in that the front side $\mathbf{103}_1$ of the frame 103, intended to face the edge of the front side $\mathbf{102}_1$ of the panel 102, includes a rigid rim portion 135 designed to bear against the lower face 102B of the panel. The rim 135 has a width $l_{135}$, along a direction Y perpendicular to the first side $\mathbf{103}_1$ of the frame 103, greater than about 0.5 centimeters, preferably between about 0.8 centimeters and about 1 centimeter. The rim 135 delimits, with the wall 104 and the rim 105, a groove 137 for accommodating the front side $\mathbf{102}_1$ of the panel 102. As shown in FIG. 8, the rim 135 extends over only a portion of the length of the front side $\mathbf{103}_1$. As a variant, the rim 135 may be longer and extend over the entire length of the front side $\mathbf{103}_1$ until being attached to the two lateral sides $\mathbf{103}_2$ and $\mathbf{103}_4$ of the frame 103, thereby further increasing the rigidity and the strength under load of the shelf 101.

In addition, the right and left lateral sides $\mathbf{103}_2$, $\mathbf{103}_4$ of the frame 103, which are intended to face the edge of the right side $\mathbf{102}_2$ and the edge of the left side $\mathbf{102}_4$ of the panel 102 respectively, each have a rim 139 designed to bear against the lower face 102B of the panel. Each of the rims 139 has a width $l_{139}$, along a direction X perpendicular to the lateral sides $\mathbf{103}_2$, $\mathbf{103}_4$ of the frame 103, less than about 0.5 centimeters and preferably between about 0.2 centimeters and about 0.3 centimeters. These widths of the rims 139 are determined so as to be compatible with the percentage shrinkage of the frame 103, which is at least 0.25% relative to the width and/or the length of the frame in its main plane, this shrinkage being, as in the first embodiment, advantageously between 0.5% and 2%, preferably around 1.5%, so that the lateral rims 139 of the frame 103 do not touch the lateral sides $\mathbf{102}_2$ and $\mathbf{102}_4$ of the panel 102 when the latter is being placed in the still-hot frame 103 and therefore do not interfere with said sides of the panel. Thus, the lateral rims 139 enable the panel 102 to be placed in the frame 103 without any obstacle, but also help to stabilize the panel 102 in the frame 103 once the frame has shrunk, by forming, with the wall 104 and the rim 105 of the frame, lateral slideways for accommodating the lateral sides $\mathbf{102}_2$ and $\mathbf{102}_4$ of the panel.

Moreover, the rear side $\mathbf{103}_3$ of the frame 103, intended to face the edge of the rear side $\mathbf{102}_3$ of the panel 102, has a rib 107A, which runs along the panel 102, being internally offset relative to the external peripheral edge of the frame 103, and projects relative to the lower face 102B of the panel when the frame encloses the panel. As clearly visible in FIGS. 9 and 11, the rib 107A defines two holes 115 suitable for each accommodating a member 114 for retaining the panel 102 in the frame 103 on its lower face 102B. More precisely, the shelf 101 has two retaining members 114, each similar to the retaining member 14D described above and joined together by a bar 181 so as to form a single piece 108. The single piece 108 is advantageously made of a rigid plastic, for example ABS or HIPS, and molded by injection molding as a single piece with the retaining members 114 positioned one relative to the other in such a way that they can be simultaneously housed in the two holes 115 of the rib 107A. As shown in FIG. 8, in the configuration in which the retaining members 114 are housed in the holes 115, the members 114 do not project from the external peripheral edge of the frame 103, this being permitted thanks to the arrangement of the rib 107A internally offset relative to the external peripheral edge of the frame. Thus, the retaining members 114 do not impede the fitting of the shelf 101 into the body of a refrigerator.

As shown in FIG. 12, each retaining member 114 comprises in succession, along the direction of a longitudinal central axis $X_{114}$ of the member, a first part 124 and a second part 123 joined together at two lateral shoulders 122 of the member. As in the case of the member 14D described above, the second part 123 of each retaining member 114 is elastically deformable for the purpose of inserting it into one of the holes 115, thanks to the presence of a central slot 125 directed parallel to the central axis $X_{114}$ and perpendicular to a free end edge 123L of the second part 123. The slot 125 of each member 114 divides the second part 123 of the member into two subparts 123*a*, 123*b* capable of coming closer together elastically. In addition, each lateral edge 129 of the second part 123 of a member 114 is inclined toward the central axis $X_{114}$, from the corresponding shoulder 122 to the free edge 123L, so as to facilitate the insertion of the member 114 into one of the two holes 115. The first part 124 of each retaining member 114 further includes a flange 127 formed on its upper face and intended, in the configuration with the retaining member 114 in one of the holes 115, to bear against the rib 107A via one of its faces 127*a*. The flange 127 is provided, in its face 127*b* opposite the face 127*a*, with a recess 128*b* for applying a thrust force on the member 114 in order to insert it into a hole 115.

In the fitted position, each of the two retaining members 114 of the piece 108 is prevented from moving, along its axis $X_{114}$, in one direction by the shoulders 122 and in the other direction by the flange 127 butted against the rib 107A. In particular, in the configuration in which the two retaining members 114 of the piece 108 are housed in both holes 115, the parts 124 and 123 of each member 114 are immobilized and bear respectively against the lower face 102B of the panel 102 and the rib 107A on one side of the hole 115, and against the rib 107A on the other side of the hole 115.

As described above, the first part 124 of each retaining member 114, which is intended to bear against the lower face 102B of the panel 102 in order to retain it, is rigid and has a width $l_{114}$, taken along the central axis $X_{114}$ of the retaining member, i.e. in a direction perpendicular to the rib 107A of the frame 103 in the configuration in which the retaining member 114 is in the hole 115 of this rib, greater than about 0.5 centimeters and preferably at least around 0.8 centimeters.

A method of manufacturing the shelf 101 in accordance with this second embodiment of the invention comprises steps as described below.

Firstly, the frame 103, still hot on leaving the mold, is placed on a support, for example in such a way that its face 103A, which has the edge 105 and is intended to be the upper face of the frame 103 in the position in which the shelf 101 is used, rests on the support.

Figure 10:
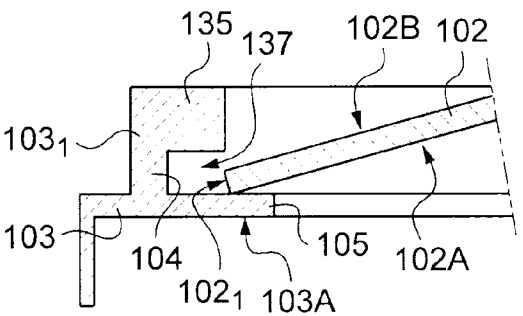
FIG. 10 is a partial cross section on a larger scale on the plane X of FIG. 9.

Next, the panel 102 is placed in the frame 103, before said frame has completely shrunk, from the side of the face 103B of the frame which is intended to be its lower face in the position in which the shelf is used. For this purpose, the front side $\mathbf{102}_1$ of the panel 102 is inserted beneath the rigid rim 135 into the groove 137 bounded by the front side $\mathbf{103}_1$ of the frame 103, as shown in FIG. 10. The panel 102 is then swung in the direction indicated by the arrow $F_1$ in FIG. 9 so as to deposit the panel 102 between the sides $\mathbf{103}_2$, $\mathbf{103}_3$ and $\mathbf{103}_4$ of the frame. The panel 102 is placed in the frame 103 while the latter is in a sufficiently hot and expanded state for there to be no interference between the internal wall 104 of the frame and the sides of the panel 102. Placing the panel 102 between the sides $\mathbf{103}_2$, $\mathbf{103}_3$ and $\mathbf{103}_4$ of the frame 103 is easy as these sides do not have, on the side of the lower face 103B of the frame, rims liable to interfere with the edges of the sides $\mathbf{102}_2$, $\mathbf{102}_3$ and $\mathbf{102}_4$ of the panel 102 when depositing said panel in the still-hot frame 103.

Figure 11:
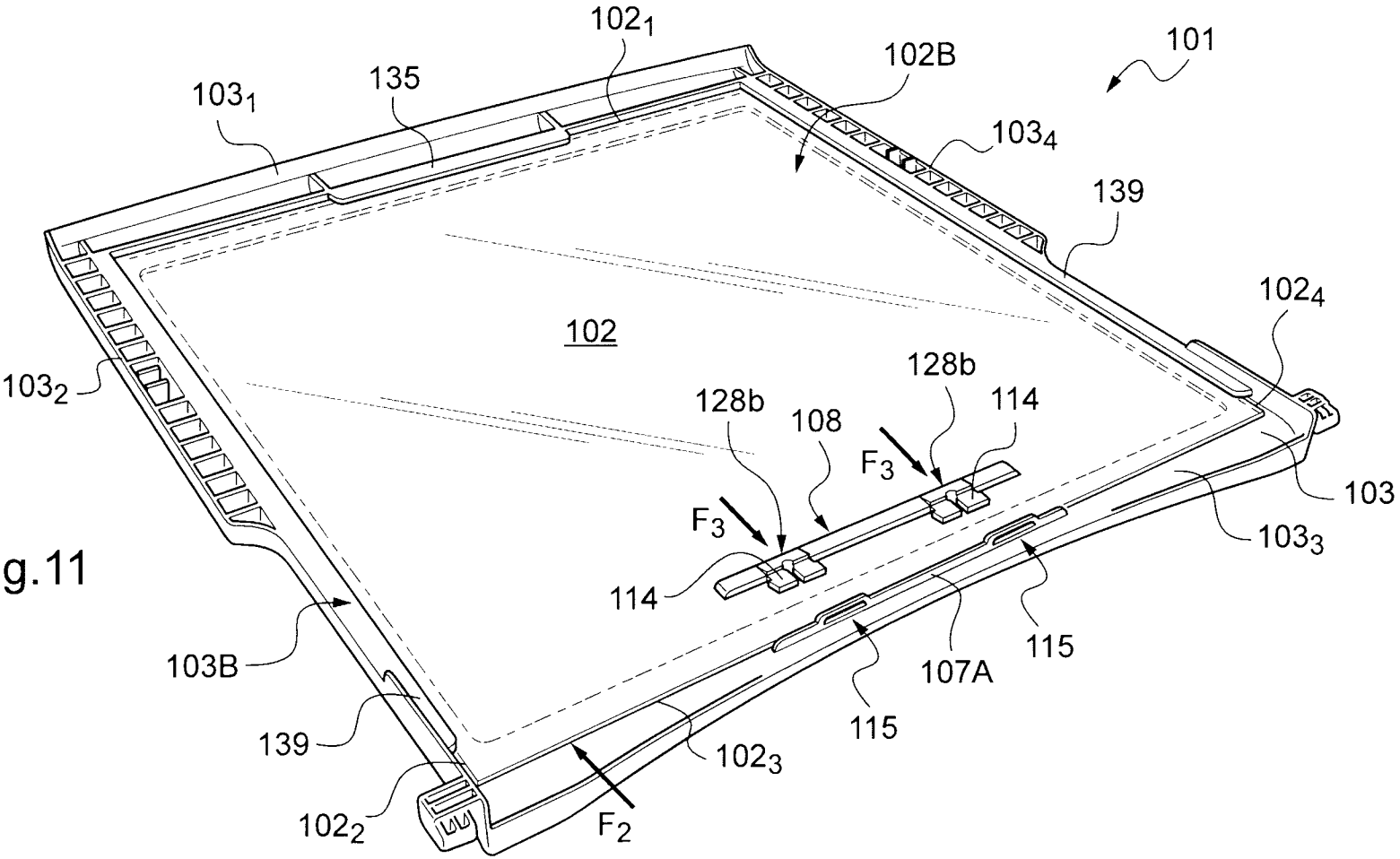
FIG. 11 is a view similar to FIG. 9 during a second step of the method of manufacturing the shelf.

Optionally, the panel 102 once in place between the sides of the frame 103 may be pushed back toward the bottom of the groove 137, i.e. toward the wall 104, as illustrated by the arrow $F_2$ in FIG. 11.

The frame 103 is then left to partially shrink around the panel 102. As in the first embodiment, the panel 102/frame 103 assembly is thus consolidated thanks to the internal wall 104 of the frame which is provided with a height greater than the thickness of the panel 102 and which encloses the panel 102 over its entire thickness.

Once the frame 103 has partially shrunk, but preferably before it has completely shrunk, the panel 102/frame 103 assembly is strengthened and locked, for safety purposes, by the insertion of the two retaining members 114 of the single piece 108 into the two holes 115 of the rib 107A on the rear side $\mathbf{103}_3$ of the frame. This insertion is generally carried out once the frame 103 is in position enclosing the panel 102. The insertion of the two members 114 of the piece 108 into the two holes 115 is carried out by exerting a thrust force on each of the two recesses 128*b* of the piece 108, in the direction of the arrows $F_3$ in FIG. 11. In practice, this thrust force may be applied manually or by means of a tool, such as a hammer. In the locked configuration of the assembly, the first part 124 of each retaining member 114 bears against the lower face 102B of the panel 102 on a first side of the corresponding hole 115, while the second part 123 bears against the rib 107A on the other side of the hole 115.

To give a nonlimiting example, in both the embodiments described above, the frame 3, 103 leaves the mold at a temperature of around 60° C. and it takes 24 hours after leaving the mold for it to be completely shrunk. However, the composition of the frame is adapted so that 80% of the frame shrinkage occurs within the 10 minutes following its removal from the mold.

Advantageously, the fitting of the panel 2, 102 into the frame 3, 103 then takes place as soon as the frame leaves the mold, at a frame temperature of around 40° C. to 60° C., preferably within a time of less than 5 minutes after it leaves the mold, whereas the fitting of the or each retaining member into a hole 15, 115 takes place when the frame is in position enclosing the panel, preferably while the frame has not yet fully shrunk, preferably within a time of less than 15 minutes after leaving the mold.

Thanks to the insertion of the or each retaining member 14, 14D, 114 into one of the holes 15, 115 of the ribs of the frame 3, 103, preferably before the frame has completely shrunk, the frame continues to shrink around the retaining member. This improves the clamping of the retaining member in the hole 15, 115.

As apparent from the embodiments described above, a shelf 1, 101 according to the invention has good rigidity. This is because the panel 2, 102/frame 3, 103 assembly of the shelf, obtained by the frame shrinking around the edges of the panel, is made secure by means of retaining the panel relative to the frame that act on the lower face 2B, 102B of the panel. These retaining means, consisting of the retaining members 14, 14D in the first embodiment and by the rim 135 and the retaining members 114 in the second embodiment, comprise parts bearing against the lower face 2B, 102B of the panel which are rigid enough and wide enough to avoid any risk of the panel being extracted from the frame. These parts bearing against the lower face 2B, 102B of the panel are designed not to be able to bent, without breakage, thereby preventing any deconsolidation of the panel relative to the frame by deformation of the bearing parts of the retaining means, even when a large weight is applied on the shelf.

Advantageously, the or each retaining member 14, 14D, 114 is shaped so as to be inserted into a hole 15, 115 via the internal side of the rib of the frame relative to the panel. As a result, the gripping part 17, 24 or 181 of the retaining member is housed behind the rib in the configuration in which the shelf 1, 101 according to the invention is used. Thus, there is little possibility of extracting the retaining member in this configuration in which the shelf is used, thereby making the panel/frame assembly more secure. The esthetics of the shelf 1, 101 are also retained as only restrained parts of the retaining members protrude from the external side of the rib relative to the panel, and these parts do not protrude relative to the external peripheral edge of the frame.

Furthermore, the method of manufacturing a shelf 1, 101 in accordance with the invention is simple and for the most part, can be easily automated. In particular, the step of placing the panel 2, 102 in the frame 3, 103, while it is still hot, before the frame has shrunk around the panel, may be carried out by a robot, especially by directly depositing the panel 2, 102 between the sides of the frame 3, 103, as in the first embodiment, or by inserting one side of the panel 2, 102 into a groove on one side of the frame 3, 103 and then by swinging the panel down between the other sides of the frame, as in the second embodiment. Advantageously, the second embodiment involves a limited number of operations for assembling the shelf, thanks to a limited number of retaining members to be inserted into the holes of the frame.

Of course, the embodiments described above have been given merely by way of indication and imply no limitation and modifications may be made without thereby departing from the scope of the present invention.

In particular, whatever the embodiment, several retaining members may be joined together to form a single piece equipped with several bars or branches each carrying a retaining member, the plurality of retaining members of the single piece being capable of simultaneously entering various holes drilled in the ribs of the frame enclosing the glass panel. In particular, such a single piece may run along all or part of the perimeter of the glass panel or equivalent. In addition, the or each retaining member of a shelf according to the invention may be welded or bonded to the frame after it has been fitted into its configuration in which the panel is locked relative to the frame of the shelf, i.e. in the configuration in which the member is housed in a hole of the frame. The panel 2, 102, once in place in the frame 3, 103, may also be bonded to the frame, especially, in the second embodiment described above, on its side housed in the groove 137 of the frame.

Moreover, in the embodiments described above, the insertion of the or each retaining member preferably takes place before the frame 3, 103 has completely shrunk. As a variant, this insertion may be carried out subsequently and, in this case, since the locking of each retaining member in the rib of the groove is less secure, it is advantageous to provide mechanical means suitable for preventing the retaining member from being extracted from the hole 15, 115 of the rib, for example saw teeth on the retaining member and/or the wall of the hole, these being directed so as to prevent extraction of the member.

As mentioned above, a shelf in accordance with the invention may also comprise either a frame covering all the edges of the panel, or part of a frame covering only certain edges, or part of the edges of the panel. In addition, in the first embodiment, the rib 7A, 7B of the frame may be formed so as to be discontinuous, and not continuous as shown in FIG. 2, over the entire perimeter of the frame 3 or over part of the frame 3. In the second embodiment, the retaining members 114 of the single piece 108 may also be of any suitable type other than the variant 14D, especially of the type of the retaining members 14 of the first embodiment, which may easily be injection-molded as a single piece with a joining bar 181. In addition, the single piece 108 may have more than two retaining members joined together. Moreover, the rigid rim 135 and the rib 107A of the frame may be placed differently on the sides of the frame, as long as they remain positioned on two opposed sides of the frame. In particular, the rim 135 and the rib 107A may be provided on the front side $\mathbf{103}_1$ and on the rear side $\mathbf{103}_3$ of the frame respectively, i.e. the reverse of that of the embodiment described and shown, or else on the right lateral side $\mathbf{103}_2$ and the left lateral side $\mathbf{103}_4$ of the frame.

The invention claimed is:

1. A shelf for an item of furniture, comprising:

a panel for supporting articles;

a plastic frame that encloses the panel, the frame allowing the shelf to be fitted into a body of the item of furniture; and at least one retaining member for retaining the panel at a lower face thereof, wherein the retaining member is insertable laterally through a hole made in a rib of the frame, the rib running along the panel while being offset internally relative to an external peripheral edge of the frame, the rib projecting beyond the panel, the retaining member being fastenable onto or behind a border wall of the hole, the retaining member bearing, in the fastened position, against the panel, and wherein the retaining member is insertable into the hole via an internal side of the rib relative to the panel, wherein the frame includes a rigid rim that extends along a surface of the panel, such that an edge of the panel is secured between each of the rigid rim and the at least one retaining member, and wherein the constituent material of the retaining member has a thermal expansion coefficient lower than the thermal expansion coefficient of the constituent material of the frame.

2. The shelf as claimed in claim 1, wherein the rib of the frame is located on an internal edge of sides of the frame.

3. The shelf as claimed in claim 1, wherein an internal face of the rib of the frame is coincident with an internal face of the wall of the frame that encloses the panel over an entire thickness thereof in the fitted position.

4. The shelf as claimed in claim 1, wherein the retaining member comprises a first part and a second part which, in the configuration with the retaining member in the hole, bear respectively against a lower face of the panel on one side of the hole and against the rib on the inside or on the other side of the hole.

5. The shelf as claimed in claim 4, wherein the first part of the retaining member is rigid and has a width, along a direction of the retaining member perpendicular to the rib of the frame in the configuration with the retaining member in the hole, greater than about 0.5 centimeters.

6. The shelf as claimed in claim 1, wherein the retaining member is a plate comprising a first part and a second part, the second part being a part with a tapered end that is insertable into the hole, the first and second parts bearing, in the configuration with the retaining member in the hole, respectively against a lower face of the panel and the rib on one side of the hole and against the rib on the other side of the hole.

7. The shelf as claimed in claim 1, wherein the retaining member comprises a first part and a second part joined together in at least one shoulder of the retaining member, the second part being elastically deformable and insertable into the hole, the first and second parts bearing, in the configuration with the retaining member in the hole, respectively against a lower face of the panel and the rib on one side of the hole and against the rib on the other side of the hole.

8. The shelf as claimed in claim 7, wherein the second part of the retaining member includes at least one slot which is directed along a direction of insertion of the second part into the hole and which divides the second part into subparts that come closer together elastically.

9. The shelf as claimed in claim 7, wherein the second part of the retaining member has at least one lateral edge inclined toward a central axis of the second part from the shoulder to a free edge of the second part.

10. The shelf as claimed in claim 7, wherein the retaining member has a flange which, in the configuration with the retaining member in the hole, butts against the rib.

11. The shelf as claimed in claim 10, wherein the flange has, in at least one external wall thereof, a recessed zone for applying a thrust force on the retaining member.

12. The shelf as claimed in claim 1, wherein shrinkage of the frame is at least 0.25% relative to dimensions of the frame in a main plane thereof.

13. The shelf as claimed in claim 1, comprising a piece that comprises several retaining members joined together and retaining the panel simultaneously at several places on a periphery of the panel.

14. The shelf as claimed in claim 1, wherein the frame has first and second opposed sides to face first and second opposed sides of the panel respectively, the first side of the frame having a rigid rim portion that bears against a lower face of the panel, and the second side of the frame having at least one second side rib of the frame, running along the panel and projecting from the lower face of the panel when the frame is enclosing the panel, the at least one second side rib includes at least one hole for accomodating one of the at least one retaining member.

15. The shelf as claimed in claim 14, comprising a piece that comprises at least two retaining members joined together, the retaining members of the piece being accommodated simultaneously in several holes made in at least one rib on the second side of the frame.

16. The shelf as claimed in claim 14, wherein the rigid rim of the first side of the frame intended to bear against the lower face of the panel has a width, along a direction perpendicular to the first side of the frame, greater than about 0.5 centimeters.

17. A method of manufacturing a shelf as claimed in claim 1, comprising:

placing the frame still hot on leaving the mold on a support;

inserting the panel into the still-hot frame, from the side of the face of the frame which is to be a lower face thereof when the shelf is in a use position; and inserting each retaining member into a hole made in a rib of the frame.

18. The method as claimed in claim 17, wherein each retaining member is inserted into a hole of a rib of the frame before the frame has completely shrunk.

19. The method as claimed in claim 17, wherein each retaining member is inserted into a hole of a rib of the frame via an internal side of the rib relative to the panel.

20. The method as claimed in claim 17, wherein the frame has first and second opposed sides to face first and second opposed sides of the panel respectively, the first side of the frame having the rigid rim for bearing against a lower face of the panel, and the second side of the frame having at least one second side rib of the frame, running along the panel and projecting from the lower face of the panel when the frame is enclosing the panel, the at least one second side rib includes at least one hole for accomodating one of the at least one retaining member, wherein the panel is inserted into the still-hot frame by introducing the first side of the panel beneath the rigid rim of the first side of the frame and then depositing the panel between the other sides of the frame.

21. An item of furniture, comprising at least one shelf as claimed in claim 1.

* * * * *